United States Patent [19]

Huggins et al.

[11] 4,273,069

[45] Jun. 16, 1981

[54] DEVELOPMENT SYSTEM

[75] Inventors: Raymond W. Huggins, Pittsford; Paul W. Burnham, Webster; Arthur L. Torrey, Irondequoit, all of N.Y.

[73] Assignee: Xerox Corporation, Stamford, Conn.

[21] Appl. No.: 50,717

[22] Filed: Jun. 21, 1979

[51] Int. Cl.[3] ..... B05C 19/00; G05G 15/00

[52] U.S. Cl. ..... 118/658; 118/653; 118/656; 118/657; 118/241; 355/3 DD; 430/122

[58] Field of Search ..... 118/653, 656, 657, 658, 118/241; 355/3 DD; 430/122

[56] References Cited

U.S. PATENT DOCUMENTS

| | | | |
|---|---|---|---|
| 2,791,949 | 5/1957 | Simmons et al. | 118/657 X |
| 2,954,006 | 9/1960 | Lawrence | 118/637 |
| 3,558,339 | 1/1971 | Randall | 118/241 X |
| 3,621,816 | 11/1971 | Donalies | 118/653 |
| 3,636,924 | 1/1972 | Weiler | 355/3 DD X |
| 3,645,770 | 2/1972 | Flint | 118/657 X |
| 3,702,108 | 11/1972 | Altmann | 118/637 |
| 3,990,394 | 11/1976 | Katakura | 118/658 |
| 4,096,826 | 6/1978 | Strange | 118/656 |

*Primary Examiner*—Shrive P. Beck

*Attorney, Agent, or Firm*—H. M. Brownrout; C. A. Green; H. Fleischer

[57] ABSTRACT

An apparatus in which a latent image is developed with particles having low conductivity. The particles are attracted to a member vibrating relative to the latent image. This increases the bulk conductivity of the particles being deposited on the latent image so as to improve development thereof.

16 Claims, 4 Drawing Figures

DEVELOPMENT SYSTEM

This invention relates generally to an apparatus for developing a latent image with particles. An apparatus of this type is frequently employed in an electrophotographic printing machine.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer mix into contact therewith. This forms a powder image on the photoconductive member which is subsequently transferred to a copy sheet. Finally, the powder image is heated to permanently affix it to the copy sheet in image configuration.

Frequently, the developer mix comprises toner granules adhering triboelectrically to carrier granules. This two component mixture is brought into contact with the latent image. The toner particles are attracted from the carrier granules to the latent image forming a powder image thereof. Alternatively, a single component developer material may be employed. In general, the developer particles have resistivities ranging from about $10^8$ to about $10^{16}$ ohm-centimeters. It has been found that particles having low resistivity develop well. However, low resistivity particles transfer poorly. Contrariwise, particles having resistivity transfer well and develop poorly. These contradictory requirements present a series problem to the machine designer. Moreover, highly resistive materials frequently have poor flow characteristics with the insulating nature thereof deleteriously effecting developability. Various techniques have been devised to improve developability.

The following disclosures appear to be relevant:

U.S. Pat. No. 2,954,006
Patentee: Lawrence
Issued: Sept. 27, 1960

U.S. Pat. No. 3,702,108
Patentee: Altmann
Issued: Nov. 7, 1972

The pertinent portions of the foregoing disclosures may be briefly summarized as follows:

Lawrence discloses a printing machine having a tape magnetized to record a magnetic latent image thereon. An endless belt moves iron oxide dust into close proximity with the magnetic latent image recorded on the tape. An agitator vibrates the belt to shake the iron oxide dust off the belt and on to the magnetic latent image recorded on the tape.

Altmann describes a development system in which developer material is deposited on a latent image recorded on a photoconductive belt. A barrier mounted diagonally across the belt causes the developer to form a standing wave and move laterally across the belt. A vibrator can be used in conjunction with the barrier to agitate the photoconductive belt. The developer is raised by a conveyor and dispensed through a slot onto the photoconductive belt. The barrier may be a blade, or paddle wheel.

In accordance with the features of the present invention, there is provided an apparatus for developing a latent image with particles having low conductivity. The apparatus includes a member spaced from the latent image to define a gap therebetween. Means are provided for attracting the particles to the member. Means induce relative vibration between the member and the latent image. This increases the bulk conductivity of the particles being deposited on the latent image.

Other aspects of the present invention will become apparent as the following description proceeds and upon reference to the drawings, in which.

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
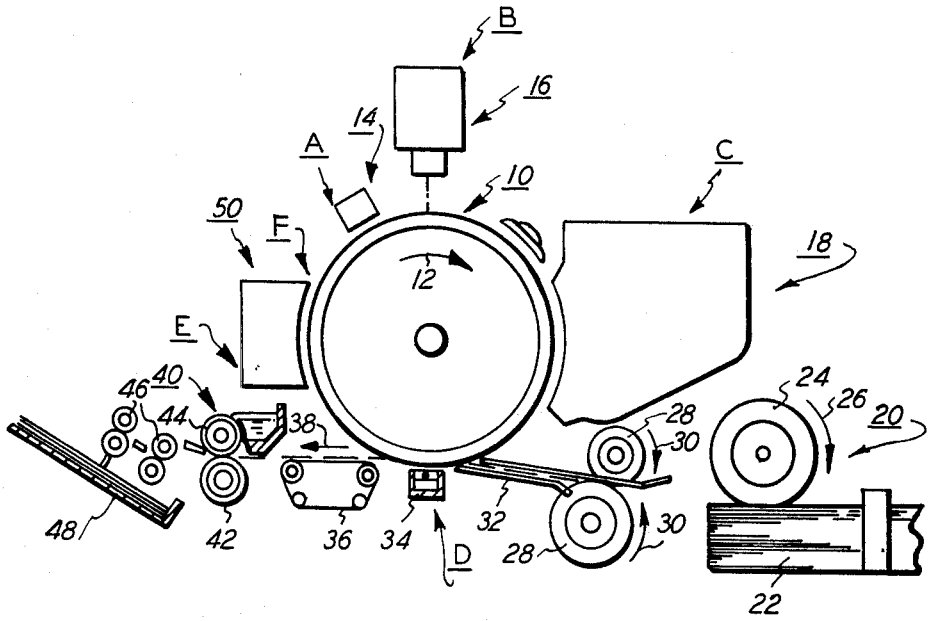
FIG. 1 is a schematic elevational view depicting an electrophotographic printing machine incorporating the elements of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development system of the present invention therein. It will become evident from the following discussion that the development system described hereinafter is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a drum 10. Preferably, drum 10 is made from a conductive substrate, such as aluminum, having a photoconductive material, e.g. a selenium alloy deposited thereon. Drum 10 rotates in the direction of arrow 12 to pass through the various processing stations disposed thereabout.

Initially, drum 10 moves a portion of the photoconductive surface through charging station A. At charging station A, a corona generating device, indicated generally by the reference numeral 14, charges the photoconductive surface of drum 10 to a relatively high, substantially uniform potential.

Thereafter, the charged portion of the photoconductive surface of drum 10 is advanced through exposure station B. At exposure station B, an original document is positioned face down upon a transparent platen. The exposure system, indicated generally by the reference numeral 16, includes a lamp which moves across the original document illuminating incremental widths thereof. The light rays reflected from the original document are transmitted through a moving lens to form incremental width light images. These light images are focused onto the charged portion of the photoconductive surface. In this manner, the charged photoconductive surface of drum 10 is discharged selectively by the light image of the original document. This records an electrostatic latent image on the photoconductive surface of drum 10 which corresponds to the informational areas contained within the original document.

Next, drum 10 advances the electrostatic latent image recorded on the photoconductive surface to development station C. At development station C, a magnetic brush development system, indicated generally by the reference numeral 18, advances the particles into contact with the electrostatic latent image recorded on the photoconductive surface of drum 10. The latent image attracts the particles thereto forming a particle image on the photoconductive surface of drum 10. One skilled in the art will appreciate that either single component or two component developer materials may be employed. When single component materials are used, the developer material is magnetic. The detailed structure of the development system will be described hereinafter with reference to FIGS. 2 through 4, inclusive. Continuing now with the various processing stations disposed in the electrophotographic printing machine, after the particle image is deposited on the photoconductive surface, drum 10 advances the particle image to transfer station D.

At transfer station D, a sheet of support material is positioned in contact with the particle image formed on the photoconductive surface of drum 10. The sheet of support material is advanced to the transfer station by a sheet feeding apparatus, indicated generally by the reference numeral 20. Preferably, sheet feeding apparatus 20 includes a feed roll 24, contacting the uppermost sheet of the stack 22 of sheets of support material. Feed roll 24 rotates in the direction of arrow 26 so as to advance the uppermost sheet from stack 22. Registration rollers 28, rotating in the direction of arrows 30, align and forward the advancing sheet of support material into chute 32. Chute 32 directs the advancing sheet of support material into contact with the photoconductive surface of drum 10 in a timed sequence. This insures that the particle image contacts the advancing sheet of support material at transfer station D.

Transfer station D includes a corona generating device 34 which applies a spray of ions to the backside of the sheet. This attracts the particle image from the photoconductive surface of drum 10 to the sheet. After transfer, the sheet continues to move with drum 10 and is separated therefrom by a detack corona generating device (not shown) which neutralizes the charge causing the sheet to adhere to the drum. Conveyor 36 advances the sheet, in the direction of arrow 38, from transfer station D to fusing station E.

Fusing station E, indicated generally by the reference numeral 40, includes a back-up roller 42 and a heated fuser roller 44. The sheet of support material with the particle image thereon passes between back-up roller 42 and fuser roller 44. The particles contact fuser roller 44 and the heat and pressure applied thereto permanently affix them to the sheet of support material. Although a heated pressure system has been described for fusing the particles to the sheet of support material, a cold pressure system may be utilized in lieu thereof. After fusing, forwarding rollers 46 advance the finished copy sheet to catch tray 48. Once the copy sheet is positioned in catch tray 48, it may be removed therefrom by the machine operator.

Invariably, after the sheet of support material is separated from the photoconductive surface of drum 10, some residual particles remain adhering thereto. These residual particles are cleaned from drum 10 at cleaning station F. Preferably, cleaning station F includes a cleaning mechanism 50 which comprises a pre-clean corona generating device and a rotatable fiberous brush in contact with the photoconductive surface of drum 10. The pre-clean corona generator neutralizes the charge attracting the particles to the photoconductive surface. The particles are then cleaned from the photoconductive surface by the rotation of the brush in contact therewith. Subsequent to cleaning, a discharge lamp floods the photoconductive surface with light to dissipate any residual electrostatic charge remaining thereon prior to the charging thereof for the next successive imaging cycle.

It is believed that the foregoing description is sufficient for purposes of the present invention to illustrate the general operation of an electrophotographic printing machine incorporating the features of the present invention therein.

Figure 2:
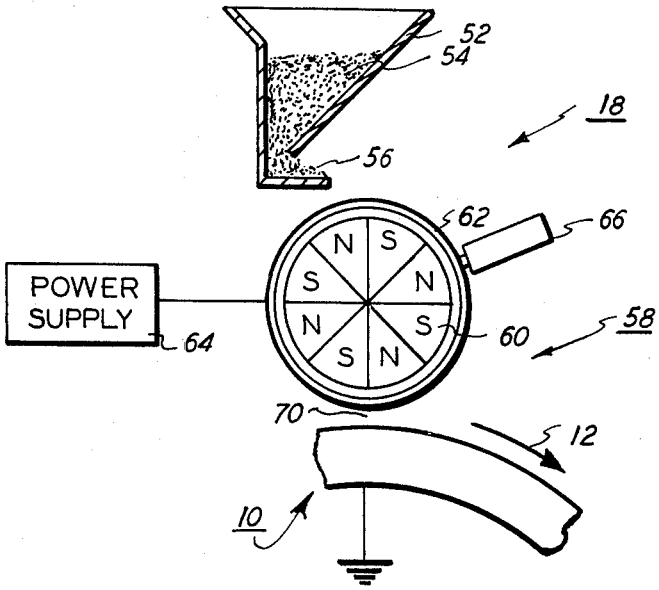
FIG. 2 is a schematic elevational view showing one embodiment of the development system employed in the FIG. 1 printing machine.

Referring now to the specific subject matter of the present invention, FIG. 2 depicts development apparatus 18 in greater detail. As shown thereat, development system 18 includes a hopper 52 storing a supply of magnetic particles 54 therein. Particles 54 descend through aperture 56 in hopper 52 onto the surface of developer roller 58. Developer roller 58 includes an elongated cylindrical magnet 60 mounted interiorly of tubular member 62. A power supply 64 electrically biases tubular member 62 to a suitable magnitude and polarity to prevent development of the background areas of the latent image with the magnetic particles. Preferably, power supply 64 electrically biases tubular member 62 with a D.C. voltage ranging from about 50 to about 500 volts. The D.C. bias level selected depends upon the background level being suppressed. Vibrator 66 causes tubular member 62 to vibrate at a frequency ranging from about 20,000 to about 100,000 hertz. Preferably, tubular member 62 is vibrated in one of its resonance modes, e.g., longitudinally radial or tangential. Vibrator 66 may be any suitable electromechanical transducer which is driven from a signal source. The transducer may be attached or in sliding contact with tubular member 62 in a suitable manner to effectuate the required vibration. The transducer may be any of the types well known in the art, such as crystal of either the piezoelectric or ferroelectric type or an electromagnetic transducer such as a voice coil or a loud speaker. The signal source actuating the transducer may be from any suitable device which generates signals suitable for driving the type of electro-mechanical transducer employed.

Various alternative techniques may be employed for vibrating tubular member 62. For example, a sinusoidal current may be transmitted along the tubular member. The interaction of the magnetic forces with electrical forces vibrates the tubular member.

As shown in FIG. 2, tubular member 62 and magnetic member 60 are substantially stationary. Actuation of vibrator 66 causes the magnetic particles attracted to tubular member 68 to advance into contact with the photoconductive surface of drum 10. Vibrator 66 vibrates tubular member 62 so as to rapidly vary the spacing or gap between the photoconductive surface of drum 10 and tubular member 62 in the development zone 70. During this vibration, the particle-to-particle charge transfer is enhanced. In addition, the acoustic pressure increases the bulk conductivity of the particles. Both effects vary as a function of the vibration frequency. Hence, the conductivity increases as a function of the vibration frequency. In addition to advancing the magnetic particles into gap 70 and increasing the bulk conductivity of the particles therein, the ultrasonic vibration of the tubular member 62 improves the flow of the particles. This is due to the fact that the charge on low conductive particles cannot readily dissipate. Thus, the electrostatic inter-particle attractive forces are high causing the particles to clump. Dissipation of the charge prevents the agglomerates from forming improving flow.

Both tubular member 62 and magnetic member 68 are stationary with the magnetic particles advancing around tubular member 62 solely due to the vibration thereof. Hence, in this latter mode of operation, no drive system is required with only a vibrator being utilized to ultrasonically vibrate tubular member 62 to achieve development. During the vibration of tubular member 62, magnetic particles advance into development zone 70 where the acoustic pressure increases the bulk conductivity thereof optimizing development.

While the member having the magnetic particles attracted releasably to the surface thereof has hereinbefore been described as being tubular, one skilled in the art will appreciate that this shape may be replaced by any other suitable configuration. The tubular shape will be the preferred configuration when either the member or magnet is rotated. These latter embodiments will be described hereinafter with reference to FIGS. 3 and 4.

Figure 3:
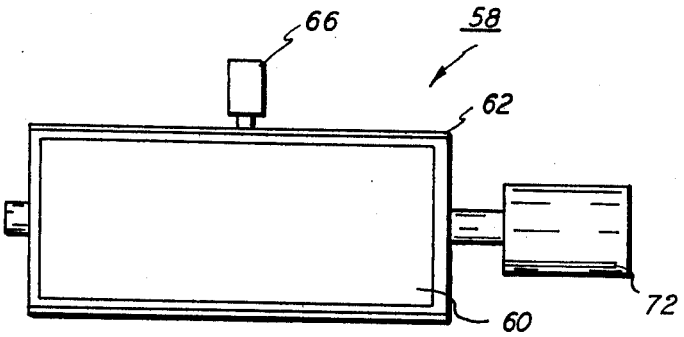
FIG. 3 is a schematic elevational view showing another embodiment of the tubular member and associate drive systems used in the FIG. 2 development system.

Referring now to FIG. 3, there is shown the embodiment of the development system wherein tubular member 62 rotates and magnetic member 60 remains stationary. As depicted thereat, a direct drive or constant speed motor 72 is coupled to tubular member 62. Tubular member 62 is mounted rotatably on suitable bearings. Motor 72 rotates tubular member 62 with magnetic member 60 remaining substantially fixed or stationary. The bearings supporting tubular member 62 rotatably are mounted in a frame supported by flexible supports, such as leaf springs. Vibrator 66 is in sliding contact with tubular member 62. Hence, as tubular member 62 rotates, vibrator 66 causes it to oscillate rapidly varying gap 70. Preferably, motor 72 is coupled to tubular member 62 through a flexible coupling, such as a bellows. This permits vibrator 66 to ultrasonically vibrate tubular member 62 during the rotation thereof.

Figure 4:
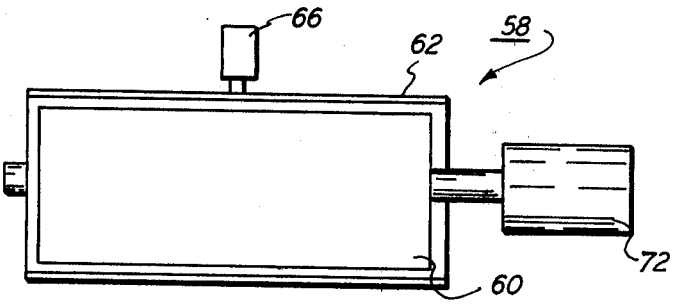
FIG. 4 is a schematic elevational view depicting another embodiment of the tubular member and associate drive system used in the FIG. 2 development system.

Turning now to FIG. 4, there is shown the drive mechanism for the configuration in which motor 62 is coupled directly to magnetic member 60. Magnetic member 60 is mounted rotatably on suitable bearings. Tubular member 62 is mounted on flexible mountings, such as leaf springs, to permit the vibration thereof. As motor 72 rotates magnetic member 60, vibrator 66 ultrasonically vibrates tubular member 62. This ultrasonic vibration rapidly varies gap 70 increasing the bulk conductivity and flow of the magnetic particles therein to improve development of the latent image. Preferably, motor 72 is a direct drive motor.

While the various embodiments hereinbefore described refer to a single component magnetic particles, one skilled in the art will appreciate that two component developer materials in which toner particles adhere triboelectrically to magnetic carrier granules may also be employed.

In recapitulation, it is clear that the improved development system of the present invention utilizes an ultrasonic vibrator to rapidly vary the gap between the tubular member and the photoconductive member so as to advance the magnetic particles thereto. This vibration improves the particle flow and increases the bulk conductivity of the particles within the gap. The increased conductivity in the development zone significantly improves development of the latent image while maintaining low conductivity to optimize transfer.

It is, therefore, evident that there has been provided, in accordance with the present invention, an apparatus for developing an electrostatic latent image recorded on a photoconductive surface. This apparatus fully satisfies the aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image with particles having low conductivity, including:

a member spaced from the latent image to define a gap therebetween:

means for attracting the particles to said member, said attracting means comprising means for generating a magnetic field to attract particles to said member; and means for reducing the particle to particle electrostatic attractive force and increasing the bulk conductivity of the particles on said member to improve the flow of the particles and development of the latent image with the low conductivity particles, said reducing means comprising a vibrator coupled to said member for vibrating said member relative to the latent image.

2. An apparatus as recited in claim 1, further including means for producing relative movement between said member and the magnetic field to move the particles attracted to said member into contact with the latent image.

3. An apparatus as recited in claim 2, wherein said member includes a rotatably mounted tubular member.

4. An apparatus as recited in claim 3, wherein said generating means includes a magnetic member disposed interiorly of said tubular member.

5. An apparatus as recited in claim 4, wherein said producing means includes means for rotating said tubular member relative to said magnetic member with said magnetic member being substantially stationary.

6. An apparatus as recited in claim 4, wherein said producing means includes means for rotating said magnetic member relative to said tubular member with said tubular member being substantially stationary.

7. An apparatus as recited in claims 5 or 6, further including means for electrically biasing said tubular member relative to the member having the latent image recorded thereon.

8. An apparatus as recited in claim 6, wherein said vibrator vibrates said tubular member at a frequency range from about 20,000 hertz to about 100,000 hertz.

9. An electrophotographic printing machine of the type in which an electrostatic latent image recorded on a photoconductive member is developed with particles having low conductivity, wherein the improvement includes:

a member spaced from the photoconductive member to define a gap therebetween;

means for attracting the particles to said member, said attracting means comprising means for generating a magnetic field to attract particles to said member; and means for reducing the particle to particle electrostatic attractive force and increasing the bulk conductivity of the particles on said member to improve the flow of the particles and development of the latent image with the low conductivity particles, said reducing means comprising a vibrator coupled to said member for vibrating said member relative to the latent image.

10. A printing machine as recited in claim 9, further including means for producing relative movement between said member and the magnetic field to move the particles attracted to said member into contact with the electrostatic latent image recorded on the photoconductive member.

11. A printing machine as recited in claim 10, wherein said member includes a rotatably mounted tubular member.

12. A printing machine as recited in claim 11, wherein said generating means includes a magnetic member disposed interiorly of said tubular member.

13. A printing machine as recited in claim 12, wherein said producing means includes means for rotating said tubular member relative to said magnetic member with said magnetic member being substantially stationary.

14. A printing machine as recited in claim 12, wherein said producing means includes means for rotating said magnetic member relative to said tubular member with said tubular member being substantially stationary.

15. A printing machine as recited in claims 13 or 14, further including means for electrically biasing said tubular member relative to the photoconductive member having the electrostatic latent image recorded thereon.

16. A printing machine as recited in claim 15, wherein said vibrator vibrates said tubular member at a frequency ranging from about 20,000 hertz to about 100,000 hertz.

* * * * *